US010036129B2

(12) United States Patent
Oetken et al.

(10) Patent No.: US 10,036,129 B2
(45) Date of Patent: Jul. 31, 2018

(54) VIBRATORY COMPACTING MACHINE

(71) Applicant: Caterpillar Paving Products Inc., Brooklyn Park, MN (US)

(72) Inventors: Nicholas Alan Oetken, Brooklyn Park, MN (US); Federico Rio, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 29 days.

(21) Appl. No.: 15/133,939

(22) Filed: Apr. 20, 2016

(65) Prior Publication Data

US 2017/0306572 A1 Oct. 26, 2017

(51) Int. Cl.
*E01C 19/00* (2006.01)
*E01C 19/28* (2006.01)

(52) U.S. Cl.
CPC ..... *E01C 19/282* (2013.01); *E01C 19/288* (2013.01)

(58) Field of Classification Search
CPC ..... E01C 19/282; E01C 19/288
USPC ..... 404/84.05, 117
See application file for complete search history.

(56) References Cited

U.S. PATENT DOCUMENTS 3,797,954 A 3/1974 Harris
3,892,496 A * 7/1975 Lebrero Martinez ... B06B 1/164 404/117
3,896,677 A 7/1975 Larson
4,310,261 A * 1/1982 Opderbeck ..... E01C 19/282 180/20
4,870,601 A 9/1989 Sandstrom
5,164,641 A * 11/1992 Quibel ..... E01C 19/288 318/128
5,177,415 A * 1/1993 Quibel ..... E01C 19/288 318/128
5,397,198 A 3/1995 Bertrand
5,781,874 A * 7/1998 Troppman ..... E01C 19/288 404/117
6,460,006 B1 10/2002 Corcoran
6,829,986 B2 12/2004 Richter
8,393,826 B1 3/2013 Marsolek et al.
8,556,039 B2 10/2013 Marsolek et al.
9,139,965 B1 9/2015 Frelich et al.
2003/0082003 A1* 5/2003 Potts ..... E01C 19/286 404/117

(Continued)

FOREIGN PATENT DOCUMENTS

CN 2718042 Y 8/2005
CN 103758013 B 12/2015
GB 1460346 A 1/1977

*Primary Examiner* — Raymond W Addie
(74) *Attorney, Agent, or Firm* — Miller, Matthias & Hull

(57) ABSTRACT

A vibratory compacting machine may include an engine, a main frame supporting the engine, and a compacting element mounted on the main frame and driven by the engine. The vibratory compacting machine may further include a vibratory system housed within the compacting element and configured to rotate about a rotation axis to vibrate the compacting element. The vibratory compacting machine may further include a control system configured to control a direction of rotation of the vibratory system. The control system may reverse the direction of rotation of the vibratory system when a predetermined number of pass counts is reached or when a predetermined density of the compactable material is reached.

20 Claims, 4 Drawing Sheets

(56) References Cited

U.S. PATENT DOCUMENTS

| | | | | |
|---|---|---|---|---|
| 2013/0136539 | A1* | 5/2013 | Aardema | G01K 1/024 404/75 |
| 2016/0054283 | A1* | 2/2016 | Stromsoe | E02D 1/02 73/488 |
| 2016/0109858 | A1* | 4/2016 | Oetken | E01C 19/288 404/84.05 |
| 2017/0016184 | A1* | 1/2017 | Oetken | B06B 1/16 |

* cited by examiner

VIBRATORY COMPACTING MACHINE

TECHNICAL FIELD

The present disclosure generally relates to construction and earth-moving machines and, more specifically, relates to vibratory compacting machines used to compact material.

BACKGROUND

Vibratory compacting machines are commonly used in construction to compact material, such as soil, gravel, or asphalt. For example, vibratory compacting machines may be used to compact freshly laid asphalt, gravel, or soil for road construction, road maintenance, or budding construction purposes. Vibratory compacting machines typically include one or more compacting elements, such as a drum, a tire, or a plate, that is vibrated to apply compaction forces on the compactable material. A vibratory system may be housed within the compacting element to induce vibration of the compacting element. Such vibratory systems may include a shaft that rotates about a rotation axis of the compacting element, and an eccentric weight rotatably coupled to shaft that rotates with the shaft to cause vibration of the compacting element. The shaft and the eccentric may be rotated in a direction that correlates with the direction of travel of the compacting machine.

Vibratory compacting machines can control both the amplitude and the frequency of vibration of the vibratory system to adjust the degree of compaction. For instance, in U.S. Pat. No. 8,393,826, a key shaft engages a pair of inner and outer concentrically positioned eccentric weights to induce rotation of the inner eccentric weight with respect to the outer eccentric weight. Specifically, when the inner and outer eccentric weights are out of phase with each other (on opposite sides of the shaft axis), the vibratory system operates at a minimum amplitude, whereas when the inner and outer eccentric weights are in phase with each other (on the same side of the shaft axis), the vibratory system operates at maximum amplitude.

Although effective, the aforementioned systems do not address problems with decompaction of the compactable material. Decompaction may occur when the compacting machine exerts significant force on the compactable material after it has reached a certain compaction level, such that the compaction reverses and the compactable material begins to separate. When this occurs, the compaction process may need to be repeated to reestablish the compaction level that was lost, thereby adding to the total compaction time and decreasing the efficiency of the compaction process. Thus, there is a need for strategies for reducing or minimizing the decompaction of compactable materials when using vibratory compacting machines.

SUMMARY

In accordance with one aspect of the present disclosure, a vibratory compacting machine is disclosed. The vibratory compacting machine may comprise an engine, a main frame supporting the engine, and a compacting element mounted on the main frame and driven by the engine. The compacting element may be configured to compact a compactable material. The vibratory compacting machine may further comprise a vibratory system housed within the compacting element and configured to rotate about a rotation axis to vibrate the compacting element. The vibratory compacting machine may further comprise a control system configured to control a direction of rotation of the vibratory system. The control system may reverse the direction of rotation of the vibratory system from a direction corresponding to a direction of travel of the compacting machine to an opposite direction when a predetermined number of pass counts over the compactable material is reached.

In accordance with another aspect of the present disclosure, a vibratory compacting machine configured to drive in a direction of travel and compact a compactable material in a compaction operation is disclosed. The vibratory compacting machine may comprise an engine, a main frame supporting the engine, and a front compacting element and a rear compacting element mounted on the main frame and driven by the engine. The vibratory compacting machine may further comprise a vibratory system associated with at least one of the front compacting element and the rear compacting element. The vibratory system may be configured to rotate about a rotation axis in a direction corresponding to the direction of travel at an outset of the compaction operation, and automatically switch to an opposite direction of rotation about the rotation axis when a predetermined number of pass counts over the compactable material is reached or when a predetermined density of the compactable material is reached.

In accordance with another aspect of the present disclosure, a control system for controlling a direction of rotation of a vibratory system of a vibratory compacting machine is disclosed. The vibratory compacting machine may include a compacting element and the vibratory system may be configured to rotate about a rotation axis to cause a vibration of the compacting element. The control system may reverse a direction of rotation of the vibratory system when a predetermined number of pass counts is reached or when a predetermined density of the compactable material is reached.

These and other aspects and features of the present disclosure will be more readily understood when read in conjunction with the accompanying drawings.

DETAILED DESCRIPTION

Figure 1:
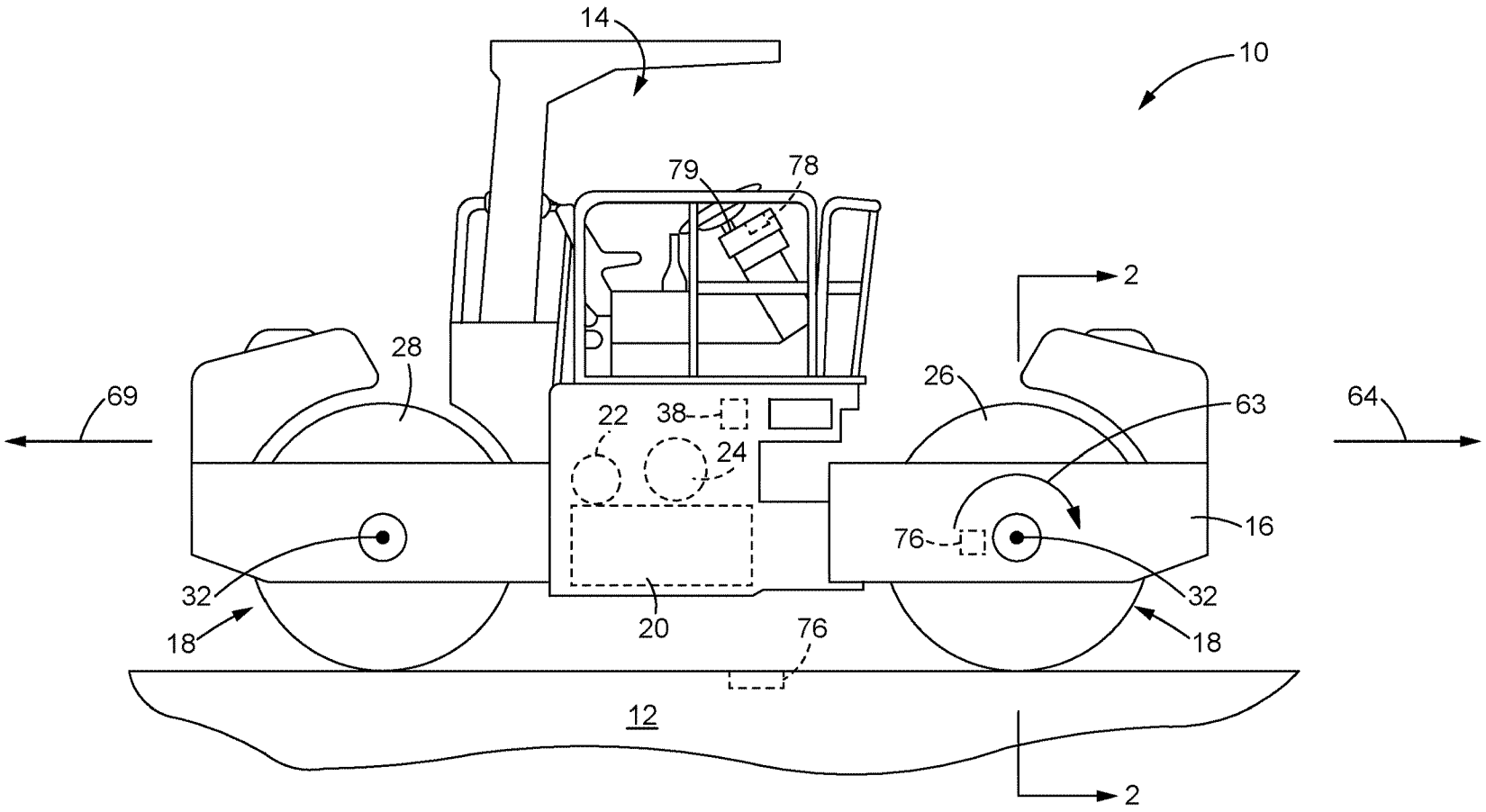
FIG. 1 is a schematic side view of a vibratory compacting machine, constructed in accordance with the present disclosure.
Figure 2:
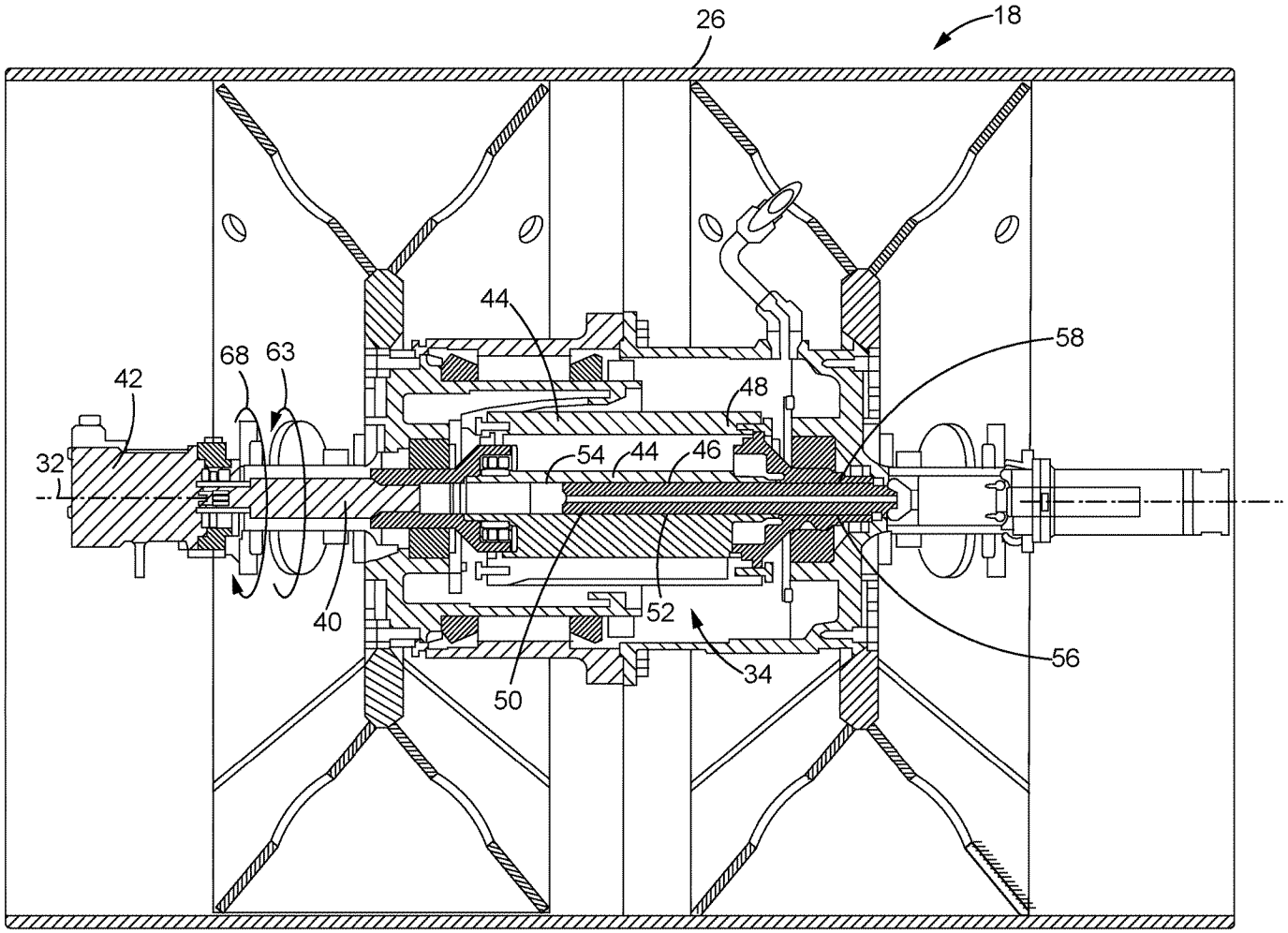
FIG. 2 is a cross-sectional view through the section 2-2 of FIG. I, illustrating a vibratory system of the compacting machine, constructed in accordance with the present disclosure.

Referring now to the drawings, and with specific reference to FIGS. 1-2, a vibratory compacting machine 10 is shown. The vibratory compacting machine 10 may be configured to compact a compactable material 12 to increase the density of the compactable material 12 for purposes such as, but not limited to, road construction, road maintenance, building construction, as well as other construction activities. In this regard, the compactable material 12 may be asphalt, soil, or gravel, among many other possibilities.

The compacting machine 10 may include an operator cab 14, a main frame 16, and one or more compacting elements 18 mounted on the main frame 16 that may apply a compaction force to the compactable material 12. In addition, the machine 10 may further include an engine 20, such as an internal combustion engine, for powering the compacting element(s) 18 as well as an electric generator 22 and/or a hydraulic pump 24 associated with the machine 10. The compacting elements 18 may include either or both of a front compacting element 26 on a front end of the machine 10, and a rear compacting element 28 on a rear end of the machine 10. The compacting element 18 may be a drum or a pneumatic roller, such as a tire, that rotates about a rotation axis 32 over the compactable material 12. Alternatively, the compacting element 18 may be a compacting plate that moves up and down vertically to compact the material 12.

The compacting machine 10 may further include a vibratory system 34 associated with the compacting element 18 that vibrates the compacting element 18 to increase the force of compaction on the material 12 (see FIG. 2). For example, the vibratory system 34 may be housed within the compacting element 18 for rotation about the rotation axis 32 as shown in FIG. 2. In addition, the compacting machine 10 may further include a control system 38 (see FIG. 1) in electronic communication with the vibratory system 34 for controlling a direction of rotation of the vibratory system 34 about the rotation axis 32 (as described in further detail below).

The vibratory system 34 is shown in detail in FIG. 2. The vibratory system 34 may include a vibratory shaft 40 and a vibratory motor 42 that may be rotatably coupled to the shaft 40 to drive the rotation of the shaft 40 about the rotation axis 32. The vibratory motor 42 may be a hydraulic motor that converts hydraulic energy from the hydraulic pump 24 into a rotation that is output to the shaft 40. Alternatively, the vibratory motor 42 may be an electric motor that is driven by the electric generator 22.

One or more eccentric weights 44 may be mounted on and rotatably coupled to the vibratory shaft 40 for rotation therewith to cause the vibration of the compacting element 18. For example, the eccentric weights 44 may include a pair of concentric weights, including an inner eccentric weight 46 positioned radially inside of an outer eccentric weight 48. The inner eccentric weight 46 and the outer eccentric weight 48 may each carry more weight on one radial side than the other. A key shaft 50 may engage both the inner eccentric weight 46 and the outer eccentric weight 48 to adjust the rotation of the inner eccentric weight 46 relative to the outer eccentric weight 48 to provide a desired vibration amplitude. Specifically, an axially-splined end 52 of the key shaft 50 may engage an axially-splined bore 54 of the inner eccentric weight 46, whereas a helically-splined end 56 of the key shaft 50 may engage a helically-splined bore 58 of the outer eccentric weight 48. Linear motion of the key shaft 50 within the bore 54 of the inner eccentric weight 46 may be converted into rotational motion of the inner eccentric weight 46 and the key shaft 50 with respect to the outer eccentric weight 48 by virtue of the helical interface between the key shaft 50 and the helically-splined bore 58 of the outer eccentric weight 48.

The vibrational amplitude of the vibratory system 34 may be minimized when the inner eccentric weight 46 and the outer eccentric weight 48 are positioned out of phase with each other (with weights on opposite sides of the axis 32) as shown in FIG. 2, whereas the vibrational amplitude may be maximized when the weights 46 and 48 are positioned in phase with each other (with weights on the same side of the axis 32), although various intermediate amplitude settings, may exist in between these extremes. It is further noted that although FIG. 2 shows the vibratory system 34 housed within the front compacting element 26, it will be understood that a separate vibratory system 34 may be similarly housed within the rear compacting element 28 as well. In other arrangements, only one of the front compacting element 26 or the rear compacting element 28 will have a vibratory system 34 housed therein.

Figure 3:
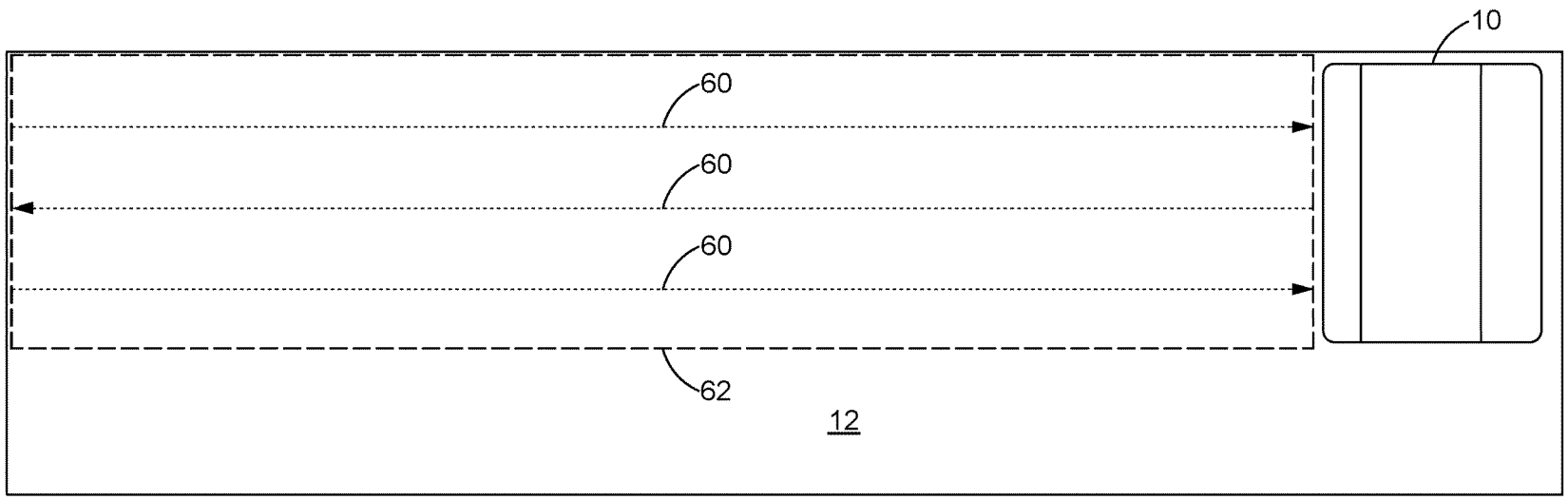
FIG. 3 is top schematic view of a job site indicating a number of pass counts completed by the compacting machine over a selected area of a compactable material, constructed in accordance with the present disclosure.

During a compaction operation, the direction of rotation of the vibratory system 34 may be reversed when a predetermined threshold, such as a number of pass counts 60 (see FIG. 3) is reached or when a predetermined density of the compactable material 12 is reached. As used herein, a "compaction operation" is an operation of compacting a selected area 62 of an uncompacted (e.g., freshly laid) compactable material 12 to a final desired compaction level using the compacting machine 10. In addition, as used herein, a "pass count" means a complete traversal of the compacting machine 10 over the selected area 62 of the compactable material 12. For example, FIG. 3 shows three pass counts 60 over the selected area 62 of the compactable material 12. Moreover, although a single compacting machine 10 is shown in FIG. 3 as making all three pass counts 60 it is to be understood that in some installations, the pass counts may be made by multiple machines 10 working in concert.

When initially compacting the material 12 at the outset of the compaction operation, the vibratory system 34 may be rotated in a clockwise direction 63 and thus in the same direction as compacting elements 18 when the machine 10 travels in a forward direction 64. In so doing, the vibratory system 34, as used herein, is said to be rotating in a direction corresponding to the direction of travel of the machine 10. Such coordination can allow relatively fast initial compaction of the material 12 (see FIGS. 1-2). However, applicants have found that continued compaction of the material 12 with the vibratory system 34 rotating in the same direction as the machine 10 moves in same direction after a certain compaction level is reached may lead to decompaction (or separation) of the material 12 due to the relatively aggressive nature of the compaction.

In order to prevent such decompaction, the direction of rotation of the vibratory system 34 of the present disclosure may be reversed to an opposite direction 68 when the predetermined number of pass counts 60 is reached when the predetermined material density is reached (see FIG. 2), or some other threshold is met. In the current example, this would cause the vibratory system to rotate in a counterclockwise direction 68, while the machine 10 travels in the forward direction 64. Compared with clockwise rotation of the vibratory system 34 in the direction 63 as the machine 10 moves in the direction 64, applicants have found that rotation of the vibratory system 34 in the opposite direction 68 while the machine 10 travels in the direction 64 provides relatively gentle compaction that increases the compaction level with reduced risks for decompaction. Reversal in the direction of rotation of the vibratory system 34 as the machine 10 moves in the direction 64 may be applied to either or both of the vibratory systems 34 of the front compacting, element 26 and the rear compacting element 28. Similarly, if the machine moves in reverse direction 69, the vibratory systems 34 may rotate in either of clockwise direction 63 and counter clockwise direction 68 as well to maximize compaction and minimize decompaction. In other cases, only one of the front compacting element 26 and the rear compacting element 28 may include a vibratory system, such that only one vibratory system 34 associated with the machine 10 will switch its rotational direction.

The predetermined number of pass counts or the predetermined density used to trigger reversal of direction may be the number of pass counts or the density of the compactable material 12 at which decompaction of the compactable material 12 starts to occur as determined from field test results. Thus, it will be understood that the predetermined number of pass counts and the predetermined density will vary depending upon a number of factors in practice, such as the type of compactable material 12 used, the thickness of the compactable material 12, the temperature of the compactable material 12, as well as numerous other factors.

Figure 4:
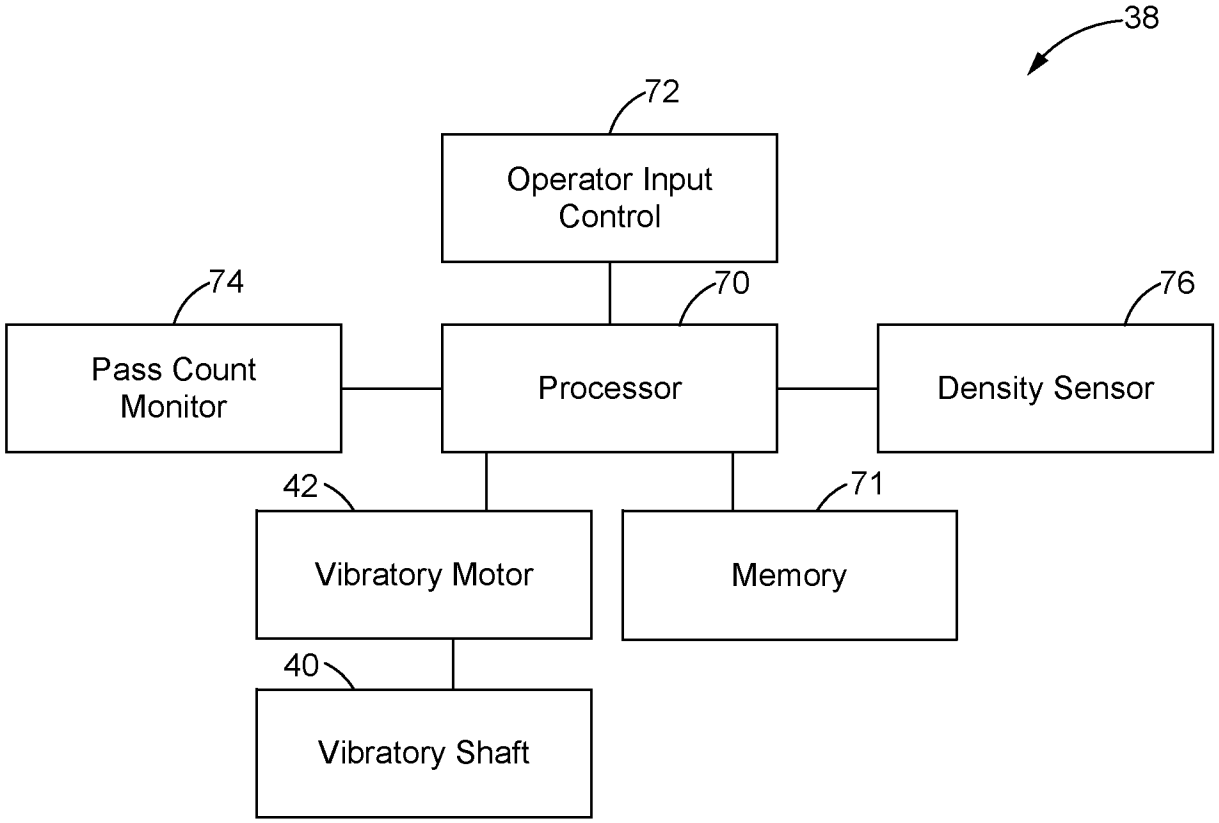
FIG. 4 is a schematic block diagram of a control system, constructed in accordance with the present disclosure.

Turning now to FIG. 4, the control system 38 for controlling the direction of rotation of the vibratory system 34 is shown. The control system 38 may include a processor 70 capable of executing specific programs involved in controlling the rotational direction of the vibratory system 34. In addition, the control system 38 may be in electrical or wireless communication with the vibratory motor 42, and may send a command to the vibratory motor 42 to switch the direction of rotation of the vibratory shaft 40 when the predetermined number of pass counts 60 is reached or when the predetermined density of the compactable material 12 is reached. In this, regard, the control system 38 may store in memory 71 predetermined thresholds for the number of pass counts and/or densities that are appropriate for the type of compactable material and compaction conditions used. Alternatively, the control system 38 may have a default setting of the predetermined number of pass counts or the predetermined density preprogrammed therein, and an operator may adjust the number of pass counts or the density as needed using operator input controls 72 in electrical or wireless communication with the control system 38.

In other arrangements, the operator may enter the desired number of pass counts or the density at which switching of the rotation direction of the vibratory system 34 is desired using the input controls 72. The latter arrangements allow the operator to adjust the number of pass counts or the material density at which switching is desired based on the specific type of compactable material used and/or other conditions at hand. As yet another alternative, the control system 38 may include a database of values for the number of pass counts or material densities at which the switching of the rotation direction should take place for different types of compactable materials and/or compaction conditions. In this case, the operator may input the type of compactable material and/or the compaction conditions at the input controls 72, and the control system 38 may select the number of pass counts or the material density from the database accordingly.

If the rotational direction of the vibratory system 34 is controlled based on a predetermined number of pass counts, the control system 38 may be in electrical or wireless communication with a pass count monitor 74 that may be located on the compacting machine 10 or at another location. For example, the pass count monitor 74 may be a position monitor, such as a global positioning system (GPS), that transmits signals to the control system 38 indicative of the number of pass counts that the compacting machine 10 has completed.

If the rotational direction of the vibratory system 34 is controlled based on the density of the compactable material 12, the control system 38 may be in electrical or wireless communication with one or more density sensors 76 capable of monitoring the density of the compactable material 12. For example, one or more density sensors 76 may be mounted on the compacting element 18 and may measure the density of the compactable material 12 based on the vibration of compacting element 18 in response to contact with the compactable, material 12 (see FIG. 1). Alternatively, one or more density sensors 76 may be placed on or near the compactable material 12 (see FIG. 1), and may emit electronic or electromagnetic signals into the material 12 to measure the material density based on reflected signals from the compactable material 12. However, some arrangements may include density sensors 76 associated with both the compacting element 18 and the compactable material 12. In any event, the density sensor(s) 76 may transmit signals indicative of the density of the compactable material 12 to the control system 38.

In an alternative arrangement, the operator may control the switching of the rotation direction of the vibratory system 34 using one or more operator-actuated inputs or switches 78 (see FIG. 1). Thus, the operator may manually trigger switching of the rotation direction when the predetermined number of pass counts has been completed, or when the predetermined material density is reached. In this regard, the operator may monitor the number of pass counts or evaluate the material density visually while the compaction operation proceeds, and switch the rotation direction to the direction opposite to the direction of travel 64 before decompaction occurs. Alternatively, the operator may monitor the number of pass counts or the material density using readable signal outputs from the pass count monitor 74 or the density sensor(s) 76, respectively. For example, the readable signal outputs may be viewable to the operator at an operator display 79 (see FIG. 1).

In some compaction operations, multiple compacting machines 10 may be arranged in tandem, in parallel, or in other patterns of cooperation on the compactable material 12 to compact a selected area of the compactable material 12, in concert, and thus more quickly. In such cases, the control systems 38 associated with each compacting machine 10 may operate independently to reverse the direction of rotation of its respective vibratory system(s) 34 from the direction 63 corresponding to the direction of travel 64, to the opposite direction 68 when the predetermined number of pass counts or material density is reached. Alternatively, the control systems 38 of the multiple compacting machines 10 may be in electrical or wireless communication with each other to coordinate the reversal in rotation direction when the predetermined number of pass counts or material density is reached.

In one possible arrangement, multiple compacting machines 10 may be arranged in tandem, with a front compacting machine 10 following a paver that lays down the compactable material 12. The vibratory system(s) 34 of the front compacting machine 10 may rotate in the direction 63 corresponding to the direction of travel 64 at the outset of the compaction operation, and may reverse rotation to direction 68 when the predetermined number of pass counts or material density is reached. In contrast, the vibratory systems 34 of the remaining compacting machines that follow the front compacting machine may rotate in the direction 68 throughout the compaction operation to apply less aggressive forces on the compactable material 12 already compacted by the front compacting machine 10. After the predetermined number of pass counts or material density is reached, the vibratory systems 34 of all of the compacting machines 10 may rotate in the direction 68 to apply gentler forces on the compactable material 12 until the desired final compaction level is reached.

INDUSTRIAL APPLICABILITY

In general, the teachings of the present disclosure may find applicability in many industries using vibratory compacting machines such as, but not limited to, road and building construction industries. More specifically, the present disclosure may find applicability in any such industry having compacting machines with rotating vibratory systems, such as, but not limited to, asphalt compacting machines.

As disclosed herein, at the outset of a compaction operation, the control system 38 may transmit a command to the vibratory motor 42 to rotate the shaft 40 in a direction corresponding to the direction of travel 64 of the compacting machine 10. Accordingly, the vibratory system 34 may initially rotate in clockwise direction 63 to provide relatively fast and aggressive compaction of the compactable material 12. The vibratory system 34 may continue rotating in such direction until the control system 38 receives a signal from the pass count monitor 74 indicating that the predetermined number of pass counts 60 has been reached, or until the control system 38 receives a signal from the density sensor(s) 76 indicating that the predetermined material density has been reached. When this occurs, the control system 38 may transmit a command to the vibratory motor 42 to reverse the rotational direction of the vibratory shaft 40 to the opposite direction 68, while the machine continue to travel in direction 64. Rotation of the vibratory system 34 in the opposite direction 68 provides gentler compaction with reduced risks for decompaction, and may continue until the desired final compaction level of the compactable material 12 is reached. The desired final compaction level may be assessed by the operator of the machine 10, or may be monitored using one or more density sensors 76 as described above.

Thus, the vibratory compacting machine disclosed herein is configured to automatically switch the rotational direction of the vibratory system from the direction corresponding to machine travel to the opposite direction when a predetermined number of pass counts or a predetermined density of the compactable material is reached. Rotation of the vibratory system 34 in the direction 63 corresponding to the direction of travel 64 may be beneficial at the outset of a compaction operation as many compactable materials, such as asphalt, may be time-sensitive and may cool down and become stiffer and increasingly resistant to compaction over time. Switching the rotation direction of the vibratory system to the opposite direction allows continued compaction with a gentler force that reduces or minimizes decompaction of the compactable material. As decompaction events often require recompaction to reestablish the compaction level that was lost, the compaction strategy disclosed herein may thus improve the ease and efficiency of compaction. In addition, the strategy disclosed herein may be applied to multiple compacting machines working together on a common area by coordinating the switching of the rotational direction of the vibratory systems associated with each machine. It can be seen from the above that the technology disclosed herein may find wide industrial applicability in a wide range of areas such as, but not limited to, road construction, road maintenance, building construction, and other construction applications.

What is claimed is:

1. A vibratory compacting machine, comprising:

an engine;

a main frame supporting the engine;

a compacting element mounted on the main frame and driven by the engine, the compacting element being configured to compact a compactable material;

a vibratory system associated with the compacting element and configured to rotate about a rotation axis to vibrate the compacting element; and a control system configured to control a direction of rotation of the vibratory system and being operable in a first mode in which the direction of rotation of the vibratory system corresponds to a direction of travel of the compacting machine and a second mode in which the direction of rotation of the vibratory system is opposite the direction of travel of the compacting machine, the control system automatically switching between the first mode and the second mode when a predetermined number of pass counts over the compactable material is reached.

2. The vibratory compacting machine of claim 1, wherein the compacting element includes a front compacting element and a rear compacting element, and wherein the vibratory system is housed within one of the front compacting element and the rear compacting element.

3. The vibratory compacting machine of claim 1, wherein the compacting element includes a front compacting element and a rear compacting element, and wherein each of the front compacting element and the rear compacting element includes a separate vibratory system housed therein, the control system reversing the direction of rotation of each of the vibratory systems housed within the front compacting element and the rear compacting element when the predetermined number of pass counts is reached.

4. The vibratory compacting machine of claim 1, wherein the compacting element is a drum.

5. The vibratory compacting machine of claim 1, wherein the compactable material is asphalt.

6. The vibratory compacting machine of claim 1, wherein the compactable material is soil.

7. The vibratory compacting machine of claim 1, wherein the vibratory system includes a vibratory shaft configured to rotate about the rotation axis, a motor configured to drive the rotation of the vibratory shaft, and an eccentric weight associated with the vibratory shaft for rotation therewith, the rotation of the vibratory shaft and the eccentric weight about the rotation axis causing a vibration of the compacting element.

8. The vibratory compacting machine of claim 7, wherein the eccentric weight includes a pair of concentrically positioned eccentric weights.

9. A vibratory compacting machine configured to drive in a direction of travel and compact a compactable material in a compaction operation, the vibratory compacting machine comprising:

an engine;

a main frame supporting the engine;

a front compacting element and a rear compacting element mounted on the main frame and driven by the engine; and a vibratory system associated with at least one of the front compacting element and the rear compacting element and being configured to rotate about a rotation axis in a direction corresponding to the direction of travel of the vibratory compacting machine at an outset of the compaction operation, the vibratory system being further configured to automatically switch to a direction of rotation about the rotation axis that is opposite to the direction of travel of the vibratory compacting machine when a predetermined number of pass counts over the compactable material is reached or when a predetermined density of the compactable material is reached.

10. The vibratory compacting machine of claim 9, wherein the vibratory system includes a vibratory shaft configured to rotate about the rotation axis, a motor configured to drive the rotation of the vibratory shaft, and an eccentric weight rotatably coupled to the vibratory shaft for rotation therewith, the rotation of the vibratory shaft and the eccentric weight about the rotation axis causing a vibration of the compacting element.

11. The vibratory compacting machine of claim 10, wherein the vibratory compacting machine further comprises a control system in electrical communication with the motor, the control system causing the motor to switch the direction of rotation of the vibratory shaft when the predetermined number of pass counts is reached or when the predetermined density of the compactable material is reached.

12. The vibratory compacting machine of claim 11, wherein the vibratory compacting machine further comprises a pass count monitor in communication with the control system, the pass count monitor being configured to transmit a signal indicative of the number of pass counts completed by the vibratory compacting machine to the control system.

13. The vibratory compacting machine of claim 11, wherein the vibratory compacting machine further comprises a density sensor in communication with the control system, the density sensor being mounted on at least one of the front compacting element and the rear compacting element and being configured to transmit a signal indicative of the density of the compactable material to the control system.

14. The vibratory compacting machine of claim 11, wherein the control system is in communication with a density sensor associated with the compactable material, the density sensor being configured to transmit a signal indicative of the density of the compactable material to the control system.

15. The vibratory compacting machine of claim 11, wherein the vibratory compacting machine further comprises a switch that allows an operator of the vibratory compacting machine to switch the direction of rotation of the vibratory system when the predetermined number of pass counts is reached or when the predetermined density is reached.

16. The vibratory compacting machine of claim 11, wherein each of the front compacting element and the rear compacting element include a separate vibratory system associated therewith, the control system reversing the direction of rotation of each of the vibratory systems associated with the front compacting element and the rear compacting element when the predetermined number of pass counts is reached or when the predetermined density of the compactable material is reached.

17. The vibratory compacting machine of claim 12, wherein the compactable material is asphalt or soil.

18. A control system for controlling a direction of rotation of a vibratory system of a vibratory compacting machine, the vibratory compacting machine being configured to compact a compactable material and including a compacting element and the vibratory system configured to rotate about a rotation axis to cause a vibration of the compacting element in a direction that corresponds to a direction of travel of the vibratory compacting machine, the control system automatically reversing a direction of rotation of the vibratory system to a direction that is opposite the direction of travel of the vibratory compacting machine when a predetermined number of pass counts is reached or when a predetermined density of the compactable material is reached.

19. The control system of claim 18, further comprising multiple control systems each associated with one of a plurality of vibratory compacting machines, each of the control systems being configured to reverse the direction of rotation of its respective vibratory system when the predetermined number of pass counts is reached or when the predetermined density of the compactable material is reached.

20. The control system of claim 19, wherein the multiple control systems are in communication with each other to coordinate reversing the direction of rotation of the vibratory systems associated with each compacting machine when the predetermined number of pass counts is reached or when the predetermined density is reached.

* * * * *